US010184095B1

(12) United States Patent
Nelson

(10) Patent No.: US 10,184,095 B1
(45) Date of Patent: Jan. 22, 2019

(54) DRY AND PORTABLE CALCINED PHYLLOSILICATE SPOT REMOVAL PRODUCT AND METHOD

(71) Applicant: Milissa Nelson, Minnetrista, MN (US)

(72) Inventor: Milissa Nelson, Minnetrista, MN (US)

(73) Assignee: Spot Stuff, Inc., Minnetrista, MN (US)

( * ) Notice: Subject to any disclaimer, the term of this patent is extended or adjusted under 35 U.S.C. 154(b) by 41 days.

(21) Appl. No.: 15/446,606

(22) Filed: Mar. 1, 2017

Related U.S. Application Data

(60) Provisional application No. 62/303,501, filed on Mar. 4, 2016, provisional application No. 62/303,490, filed on Mar. 4, 2016.

(51) Int. Cl.

| | |
|---|---|
| ***C11D 3/12*** | (2006.01) |
| ***C11D 3/22*** | (2006.01) |
| ***C11D 3/382*** | (2006.01) |
| ***C11D 17/06*** | (2006.01) |
| ***B65D 85/00*** | (2006.01) |

(52) U.S. Cl.
CPC ..... *C11D 3/128* (2013.01); *B65D 85/70* (2013.01); *C11D 3/1233* (2013.01); *C11D 3/222* (2013.01); *C11D 3/382* (2013.01); *C11D 17/06* (2013.01)

(58) Field of Classification Search
CPC ..... C11D 3/128; C11D 3/1233; C11D 3/222; C11D 3/382
See application file for complete search history.

(56) References Cited

U.S. PATENT DOCUMENTS 3,983,078 A * 9/1976 Collins ..... C11D 1/8305 510/453
4,321,157 A * 3/1982 Harris ..... C11D 3/124 510/306
4,329,237 A * 5/1982 Wixon ..... C11D 10/04 510/308
4,450,085 A * 5/1984 Wixon ..... C11D 10/04 510/108
4,504,407 A 3/1985 Klutz, Jr. et al.
5,061,397 A * 10/1991 Goodman ..... C11D 3/126 106/416
5,632,780 A 5/1997 Siklosi
5,765,407 A 6/1998 Choo et al.
5,990,075 A * 11/1999 Terziev ..... C11D 7/14 510/285
6,187,056 B1 2/2001 Terziev
6,644,879 B2 11/2003 Irvin et al.
6,832,867 B2 12/2004 Sandbach et al.
6,838,423 B2 1/2005 Irvin et al.
6,846,332 B2 1/2005 Boissie et al.
7,303,347 B1 12/2007 Duncan
2003/0064909 A1* 4/2003 Barnabas ..... C11D 3/38636 510/392
2011/0287997 A1* 11/2011 Busch ..... C11D 3/3932 510/302
2015/0038388 A1* 2/2015 Gallez ..... C11D 3/0026 510/122
2015/0284666 A1* 10/2015 Winkelkoetter ..... C11D 3/126 510/365

* cited by examiner

*Primary Examiner* — Charles I Boyer
(74) *Attorney, Agent, or Firm* — Eggink & Eggink; Anthony G. Eggink; Katrina M. Eggink

(57) ABSTRACT

A stain removal product formulation and method utilizing a dry, portable product. The dry, portable removal product preferably contains specially treated ingredients, including a composition of microporous silica and alumina tetrahedra and combined with aluminum dioctahedral phyllosilicates family of minerals. Ingredients may vary depending on the type of stain to treat, for example, for stains having an oil, grease or fat base. Due to the nature of stains and their varied content the product formulation may also include a combination of other dry ingredients such as clays, minerals, baking soda, corn starch, flour or other dry ingredients. Optional ingredients which may be added including dry coloring and/or dry fragrance components. The dry product formulation is provided in a powder, granule or flake form in moisture resistant packages and kits.

4 Claims, No Drawings

DRY AND PORTABLE CALCINED PHYLLOSILICATE SPOT REMOVAL PRODUCT AND METHOD

The present application claims the benefit of filed U.S. Provisional Patent Application No. 62/303,490 entitled Dry and Portable Product for the Removal of Spots, filed on Mar. 4, 2016 and U.S. Provisional Patent Application No. 62/303,501 entitled Dry and Portable Spot Removal Method, filed on Mar. 4, 2016, both of which are also incorporated by reference herein.

The present invention relates generally to a dry and portable product formulation and method for the removal of spots or stains from various substrates. The dry removal product formulation relates particularly to the use of specified minerals to provide for the removal of spots or stains containing grease, oil, or fats. The product formulation ingredients may be packaged in portable containers, such as in packets, and carried individually, in multi-packs or provided in stain removal kits.

BACKGROUND OF THE INVENTION

Instant stain removal products have been available for many years, for example, Tide® Sticks, Shout® Wipes, along with other brands of gel, spray, pens, wipes, liquids and bleach sticks. These products typically use a wet removal process whether at home or as a portable product. Wet removal methods on most occasions leave marks showing where the wet cleaning solution has dried. The present invention overcomes the disadvantages of wet removal products and provides for the improved cleaning and deodorizing of soiled items.

Almost everyone in their daily life experiences the problem of spots or stains whether at home, work, school or while traveling, for example. Travel by its very nature allows for a limited wardrobe; not easily augmented should spills occur making a dry portable formulation a preferable stain removal formulation and method.

This invention provides a dry and portable spot removal product formulation of dry and portable ingredients that is easy to use for spot removal. The dry portable product can be used to remove stubborn oil, grease or fat based spots on soiled items such as clothing, furniture, carpet, automobile and boat interiors as well as other articles or surfaces. Oil, grease or fat based spots and stains can remain even with the best cleaning attempts, including after washing at home or professional cleaning. Dry clean only and delicate fabrics typically cannot withstand a wet removal method to remove spots without damage to the fabric. Further, wet removals take an extended time to complete the full removal process, either due to washing and drying or removal by professional cleaners. Sometimes the soiled item is permanently destroyed due to the inability of the wet processes to remove the stain. The damaged item ends up in the garbage which is expensive and environmentally unsound. These prior art processes also take an extended time for removal either due to washing and drying or by requiring professional cleaners.

The present invention provides for the dry and portable spot or stain removal which may be accomplished in most cases in minutes thereby saving consumers, time and money and by using an environmentally friendly formulation. The stain removal methods on the market today for instant removal or portable use ingredients contain at least some moisture and use a wet process to remove stains. The present invention uses dry and portable ingredients and provides a unique formulation in the marketplace.

Although prior art patents relating to home dry cleaning, liquid or wet removal products, none of the prior art have satisfied the need for a method or product which provides for a dry and portable stain removal. The prior art does not satisfy the need for a product which satisfies the need for a dry and portable spot or stain removal from multiple surfaces. They further do not satisfy the need for a product which is dry and portable for the removal for oil, grease or fat based stains. The formulation and method of the present invention overcomes the shortcomings and limitations of the prior art.

SUMMARY OF THE INVENTION

The invention relates to a product formulation which is dry and portable to remove stains and a method of dry stain removal. The product formulation and method is dry and portable and can be used for soiled articles which may include stains; for example, stains containing grease, oil or fats. The formulation and method applies a dry and portable removal product for stains leaving the substrate clean and may also remove associated odors. In most cases the stain is removed in minutes, for example, three minutes. The dry portable product formulation may be comprised of silica and alumina tetrahedra and/or aluminum dioctahedral phyllosilicate families of minerals and may also contain optional components—color and fragrance.

The dry portable stain removal product formulation can also include a variety of dry ingredients for stain removal which may include clays, minerals, baking soda, flour, corn starch, and other dry ingredients which could be used for spot/stain removal.

The invention provides a product and method for completely dry and portable spot/stain removal whether the stain is old or new, washed or unwashed, including spots/stains which have been cleaned and dried previously, and from soiled articles to include but not limited to fabric, furniture, carpet, interiors on automobiles, boats, and other vehicles.

The dry and portable removal method includes the application of a dry and portable product to the stained area and can be applied to both the front and back of a surface where applicable. The dry and portable product should be allowed to sit once applied; for a period of time ranging from a few minutes, e.g, three minutes, to longer depending on the particular spot/stain content, depth, texture, size and surface from which the stain is being removed. The product formulation once applied penetrates the soiled area and absorbs the oil, grease or fat based spot/stain. The resultant product is then toweled, vacuumed or removed in any other suitable manner which preserves the surface integrity. Reapplication may be done as needed for heavy content, thick or textured items or a large stain.

The dry and portable stain removal method relates to the application of the product formulation containing a mixture of ingredients which includes microporous silica and alumina tetrahedra family of minerals. (Examples include but are not limited to the approximate 40 varieties of silica and alumina tetrahedra including analcime, natrolite, chabazite, clinoptilolite, phillipsite, stilbite and heulandite minerals both naturally occurring and synthetic)—and/or any type of aluminum dioctahedral phyllosilicate; (Examples include the family of aluminum dioctahedral minerals examples: halloysite, dickite, kaolinite and nacrite.) mixed in various ratios depending on the stain content.

The dry and portable product and method of this invention has ingredients which may be heated for a minimum of one hour at temperatures ranging from 600-1200 degrees Fahrenheit to remove moisture content. The ingredients may be combined in various ratios based on the type of spots/stains to be removed and to create an effective end product. The ingredients of the formulation penetrate the soiled article absorbing the oil, grease or fat based stain. Testing has shown that a heated formulation is more effective than non-heated formulation ingredients. The application method and product, in addition to the excellent stain removal properties, and portable nature also provides the added benefit of associated odor removal. The dry and portable ingredients can be packaged in any portable container, including but not limited to sachets, packets, bags, boxes, cans, pouches, tubes, shakers, or any other suitable portable container depending on which is best for the form of the product applied, carried individually, in multi-packs or in stain removal kits, for example. The container, e.g., a packet, may be foil-lined to preserve the dry integrity of the product and may be approximately 2 by 3 inches in size and contain approximately 2 gm of the product.

These and other advantages of this invention will become clear from the following description. Various modifications, changes or variations of the product and process of the invention and to the extent that such variations incorporate the intent of the invention are to be included within the scope of the claims.

DETAILED DESCRIPTION OF THE INVENTION

This invention is a dry and portable spot/stain removal product and method. The dry and portable product formulation incorporates ingredients that penetrate and absorb the spot/stain and the method includes the application of a dry and portable product which in the example formula incorporates ingredients that penetrate and absorb the stain. The method also includes heating of the ingredients which removes any moisture and provides for an end product capable of providing superior spot/stain removal of oil, grease and fat based stains.

The dry and portable removal product formulation can contain any number of dry products to aid in spot/stain removal to include but not limited to clay, minerals, corn starch, baking soda, flour, and any other suitable dry ingredient; but in particular the combination of two heat treated components is preferred. The dry and portable removal product can be applied in powder, flake, granular or solid form, all of which tested as having the same excellent removal properties and which include:

Silica and alumina tetrahedra family of minerals (Which include but are not limited to: analcime, natrolite, chabazite, clinoptilolite, phillipsite, stilbite, and heulandite minerals both naturally occurring and synthetic form). Silica and alumina tetrahedra minerals are an abundant mineral family formed by volcanic ashes and rock when they react with groundwater that is alkaline in nature. The preferred silica and alumina tetrahedra family of mineral compositions are those with a high sodium content, for example, $(Na,K,Ca)_{2-3}Al_3(Al,Si)_2Si_{13}O_{36}.12H_2O$.

The family of aluminum dioctahedral phyllosilicates a 1:1 mineral consisting of one tetrahedral sheet and one octahedral sheet; (examples include but are not limited to: halloysite, dickite, kaolinite and nacrite). This family of minerals has a chemical composition which is a layered silicate mineral, with one tetrahedral sheet linked through oxygen atoms to one octahedral sheet of alumina octahedra. The preferred aluminum dioctahedral phyllosilicates composition is $Al_2Si_2O_5(OH)_4$.

The preferred ingredients tested with best performance when heated in a kiln or other suitable manner for varied times at temperatures ranging between 600-1200 degrees Fahrenheit; removes all moisture content, thereby providing a completely dry and portable product with increased absorption ability and providing a more effective stain removal product and process.

The invention may have a preferred combination of ingredients comprising minerals having high absorption properties and with varied ratios of the preferred ingredients. The varied ratios effectively remove a wide variety of stains containing oil, grease or fats depending on ingredient content. For example, ratios may range from approximately 0% silica and alumina tetrahedra minerals family and 100% aluminum dioctahedral phyllosilicates family to approximately 100% silica and alumina tetrahedra minerals family and approximately 0% aluminum dioctahedral phyllosilicates family. The preferred ratio preferably contains more of the aluminum dioctahedral phyllosilicates family.

The invention incorporates a dry and portable spot/stain removal product in various ratios of preferred components. Experiments showed various ratios of the ingredients gave better results depending on the type of stain. Aluminum dioctahedral phyllosilicates family performed better in absorption of the lightweight oil, or fat, while the silica and alumina tetrahedra family of minerals showed best results in absorption of grease and heavier oils along with an increased ability to remove associated odors. The individual or combination of these preferred mineral families provided for a superior product with the ability to permeate and absorb a wide range of oil, grease or fat based spots/stains.

A fragrance component may be optionally included and consist of any available dry forms of fragrance, the selection of which will depend on personal preferences and application requirements from among the various dry fragrances available. A color component may also be included and may consist of any available dry form of colorant, the selection of which will depend on personal preferences and application requirements from among the various dry colorants available.

The invention incorporates a product and method providing and using a dry and portable removal formulation that is safe to use even on delicate or dry clean only fabrics which typically cannot use a wet based cleaning method. The product may be applied in multiple forms including but not limited to powder, granular, flake, or solid. The dry product can be packaged in various portable containers including but not limited to sachets, packets, bags, boxes, cans, pouches, tubes, shakers, or any other suitable portable container depending on which is best for the form of the product applied. The product may optionally be packaged individually, in multi-packs, or in kits which contain the dry and portable removal product along with a residue removal article such as towel, fabric, brush or other suitable non-damaging item. The container, e.g., a packet, is preferably foil-lined or the like to preserve the dry integrity of the product and may be approximately 2 by 3 inches in size and contain approximately 2 gm of the product.

Examples of preferred mineral ratios depending on the content of the stain:

Example 1

99 to 100% by volume silica and alumina tetrahedra mineral family
0 to 1% by volume aluminum dioctahedral phyllosilicates mineral family
Heated to over 600 F for minimum of 1 hour Example 2

0 to 1% by volume silica and alumina tetrahedra mineral family
99 to 100% by volume aluminum dioctahedral phyllosilicates mineral family
Heated to 600 F-1200 F for minimum of 1 hour Example 3

50% by volume aluminum dioctahedral phyllosilicates mineral family
50% by volume silica and alumina tetrahedra mineral family
Heated to 600 F-1200 F for minimum of 1 hour Example 4

Aluminum dioctahedral phyllosilicates mineral family in ratios as determined by the nature of the type of stain to be removed
Silica and alumina tetrahedra mineral family in ratios as determined by the nature of the type of spot/stain to be removed
Heated up to 1200 F for varied periods of time
Less than 1% of total weight of an optional dry fragrance Example 5

Aluminum dioctahedral phyllosilicates mineral family in ratios as determined by the nature of the type of stain to be removed.
Silica and alumina tetrahedra mineral family in ratios determined by the nature of the type of stain to be removed
Heated to 600 F-1200 F for minimum 1 hour
Less than 1% of total weight of an optional dry colorant.

The heating of the formulations set forth is primarily important for the aluminum dioctahedral phyllosilicates mineral.

In summary, the present invention relates to a dry and portable removal product formulation for stains utilizing dry ingredients. The dry and portable stain removal product can be applied in various forms to include powder, granular, flake, solid or other applicable form. The dry removal product formulation may contain a variety of dry ingredients which may include clays, minerals, baking soda, flour, corn starch, and other dry ingredients. The preferred product contains a mixture including the family of silica and alumina tetrahedra minerals in either naturally occurring and synthetic forms mixed in various ratios depending on stain content with a member of the aluminum dioctahedral phyllosilicate family, a 1:1 mineral consisting of one tetrahedral sheet and one octahedral sheet. The silica and alumina tetrahedra ingredient has the added natural ability to remove associated odors. Optional components may be added based on need or user preference. Those optional ingredients include a colorant and/or a fragrance. The product may be packaged in various portable containers including sachets, packets, bags, boxes, cans, pouches, tubes, shakers, or any other suitable portable container depending on which is best for the product to be applied. The product may be packaged individually, in multi-packs or in kits which contain the dry and portable removal product along with other items, such as a residue removal article such as towel, fabric or other suitable non-damaging item.

As many changes are possible to the dry and portable spot removal product formulation and method embodiments of this invention utilizing the teachings thereof, the descriptions above, and the accompanying drawing should be interpreted in the illustrative and not in the limited sense.

That which is claimed is:

1. A method of removing a grease or oil based stain from a substrate consisting essentially of applying a dry and portable stain removal formulation comprising a preheated aluminum dioctahedral phyllosilicates mineral.

2. The method of claim 1, wherein said applied dry and portable stain removal formulation further comprises a silica and alumina tetrahedral (zeolite) mineral.

3. The method of claim 2, wherein said preheated aluminum dioctahedral phyllosilicates mineral is preheated at least for one hour and between 600 and 1,200° F.

4. The method of claim 2, wherein said preheated aluminum dioctahedral phyllosilicates mineral is kaolinite and wherein said zeolite mineral is clinoptilolite.

* * * * *